United States Patent [19]

Kelley

[11] 4,174,532

[45] Nov. 13, 1979

[54] PORTABLE LIGHTING FIXTURE

[76] Inventor: Richard L. Kelley, 7 Elm Pl., Webster Groves, Mo. 63119

[21] Appl. No.: 798,769

[22] Filed: May 20, 1977

[51] Int. Cl.[2] ..... F21V 33/00; F21V 21/08

[52] U.S. Cl. ..... 362/102; 362/226; 362/251

[58] Field of Search ..... 362/97, 102, 134, 227, 362/249, 250, 352, 410, 414, 431, 226, 251, 396

[56] References Cited

U.S. PATENT DOCUMENTS

| | | | |
|---|---|---|---|
| 2,047,045 | 7/1936 | Veenboer | 362/249 |
| 2,087,537 | 7/1937 | Finkel | 362/102 |
| 2,453,695 | 11/1948 | Belling | 362/396 |
| 3,313,929 | 4/1967 | Schiavone | 362/102 |
| 3,683,172 | 8/1972 | Noyes | 362/431 |
| 3,721,814 | 3/1973 | Ries | 362/251 |
| 3,769,504 | 10/1973 | Hesse et al. | 362/352 |
| 3,801,809 | 4/1974 | Slade | 362/134 |
| 3,870,062 | 3/1975 | Medlin | 362/102 |

FOREIGN PATENT DOCUMENTS

| | | | |
|---|---|---|---|
| 22633 | of 1906 | United Kingdom | 362/102 |

*Primary Examiner*—William M. Shoop
*Assistant Examiner*—Peter S. Wong
*Attorney, Agent, or Firm*—Koenig, Senniger, Powers and Leavitt

[57] ABSTRACT

A portable lighting fixture for use with a patio umbrella and the like in which the umbrella is supported by a center pole having struts extending outwardly therefrom to the underside of the umbrella when the umbrella is in a raised position. A base has a slot therein extending inwardly from an edge of the base toward the center thereof for receiving the pole to removably install the base below the underside of the umbrella about the pole. The base is supported by the struts when installed. At least one electric light source is mounted on the base. Power is supplied from a source of electrical energy to the light source thereby to illuminate the area beneath the umbrella.

5 Claims, 5 Drawing Figures

PORTABLE LIGHTING FIXTURE

BACKGROUND OF THE INVENTION

This invention relates to portable lighting fixtures and more particularly to such a fixture for use with outdoor furniture such as patio umbrellas and the like.

Patio umbrellas are typically used with outdoor tables and generally are supported by a center pole rising up through the middle of one of these tables. When open, the umbrella shades people sitting at the table from the sun. The tables are typically located on patios or near swimming pools or other outdoor recreational areas and may be used in the evening at which time people sitting at them to eat, play games, etc. may have insufficient illumination for these activities. Further, these locations may be some distance away from a house, garage or other building on which outdoor lights are installed or away from places where light standards are erected. Consequently, the amount of light provided by these sources may be inadequate. Further, many of the tables are portable so that even if initially located near an outdoor light, they may, on occasion, be moved to some more distant area where the light is inadequate.

SUMMARY OF THE INVENTION

Among the several objects of the present invention may be noted the provision of a portable lighting fixture for use with a patio umbrella and the like; the provision of such a fixture which is readily installed below the underside of an umbrella to illuminate the area beneath the umbrella at night or other desired times without interfering with any activities taking place in the area; the provision of such a fixture for reflecting radiated light downwardly toward the area beneath the umbrella to increase the level of illumination in the area; the provision of such a fixture which is relatively protected from damage when installed; the provision of such a fixture with which illumination may be provided only when needed and which is unobtrusive at other times; the provision of such a fixture which is easily removable when the umbrella is to be lowered or moved; and the provision of such a fixture which is of lightweight construction and low in cost.

Briefly, a portable lighting fixture of the present invention is for use with a patio umbrella and the like in which the umbrella is supported by a center pole having struts extending outwardly therefrom to the underside of the umbrella when the umbrella is in a raised position. The fixture comprises a base having a slot therein extending inwardly from an edge of the base toward the center thereof for receiving the pole to removably install the base below the underside of the umbrella about the pole. The base is supported by the struts when installed. At least one electric light source is mounted on the base. Means are connected to a source thereby to illuminate the area beneath the umbrella. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
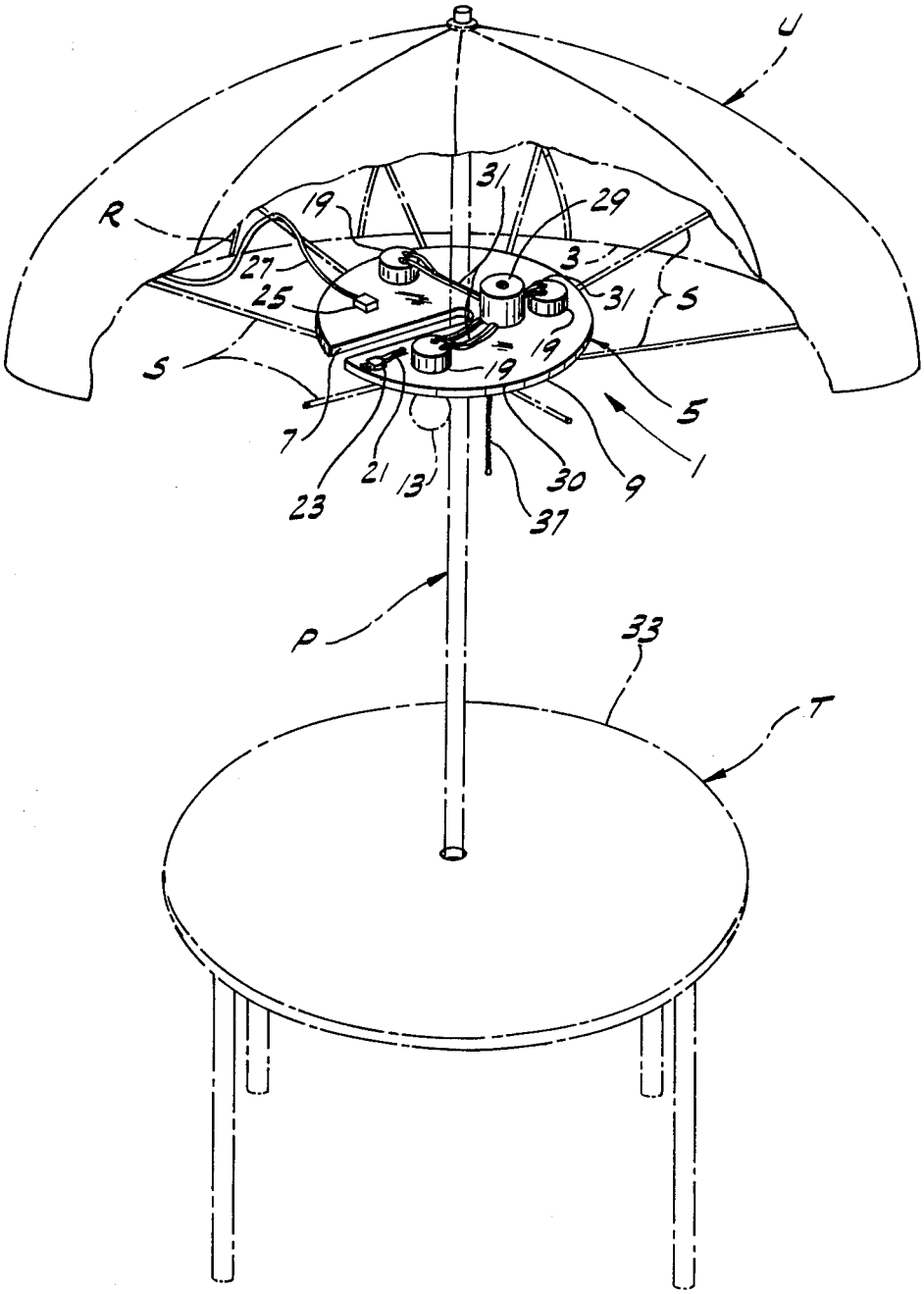
FIG. 1 is a cutaway view of a patio umbrella showing a portable light fixture of the present invention installed below the underside of the umbrella.

Referring now to the drawings, a portable light fixture of the present invention is indicated generally at 1. The light fixture is for use with a patio umbrella U which, as shown in FIG. 1, is supported by a center pole P extending upwardly from a table T. Struts S radiate outwardly from pole P to the underside 3 of umbrella U when the umbrella is in a raised position as shown.

Figure 2:
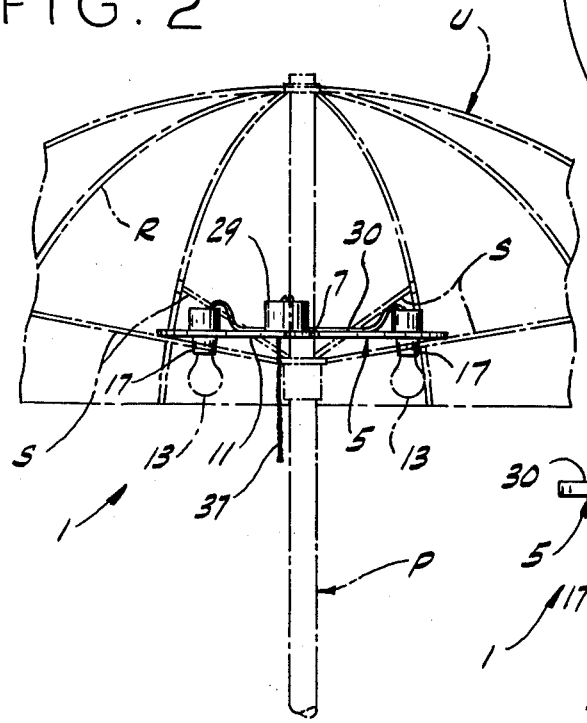
FIG. 2 is an elevation of a portable light fixture of the invention as installed.
Figure 5:
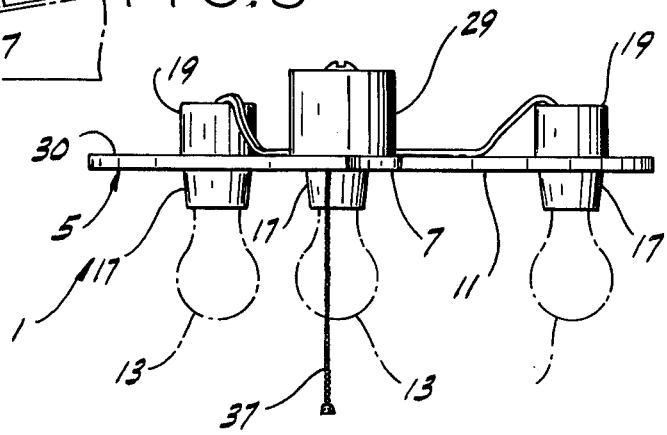
FIG. 5 is an enlarged side elevation of a portable light fixture of the invention.

Portable light fixture 1 comprises a base 5 which is preferably generally planar and circular in shape and made of a rigid lightweight material such as wood or foamed synthetic resin. A slot 7 is formed in base 5 and extends inwardly from edge 9 of the base toward the center of the base. For a circular base 5, slot 7 is a radial slot. Center pole P is received in slot 7 at the inward end thereof to removably install base 5 about the pole below underside 3 of umbrella U. For this purpose, slot 7 has a width approximately equal to but greater than the width (i.e., diameter) of pole P and extends somewhat past the center of base 5. The slot has a rounded end 10 whose radius of curvature approximates that of pole P. When installed, base 5 is supported by struts S, preferably resting on them so as to be positioned in a generally horizontal plane as shown in FIG. 2.

Figure 3:
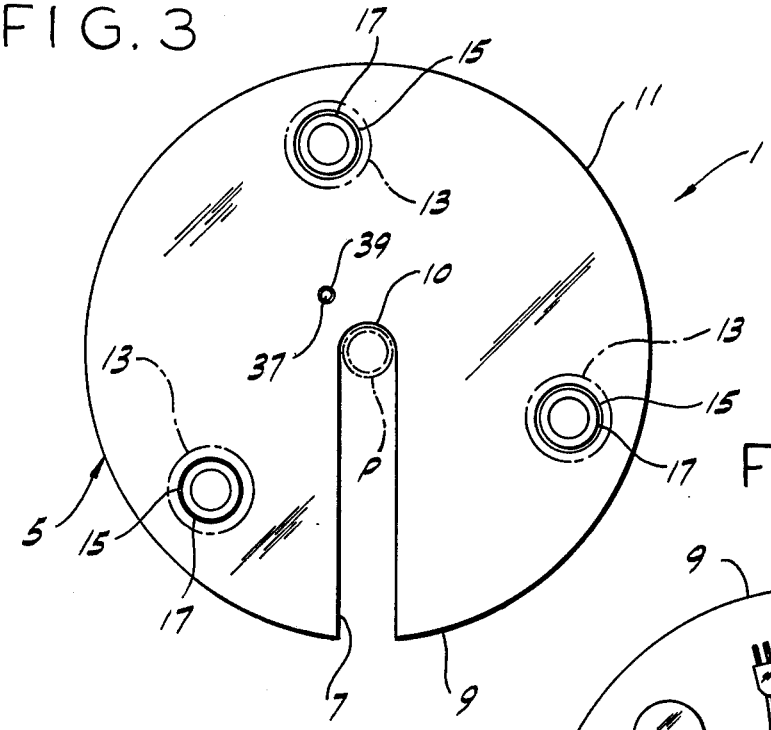
FIG. 3 is an enlarged bottom plan of a portable light fixture of the invention showing the lower surface of the fixture.
Figure 4:
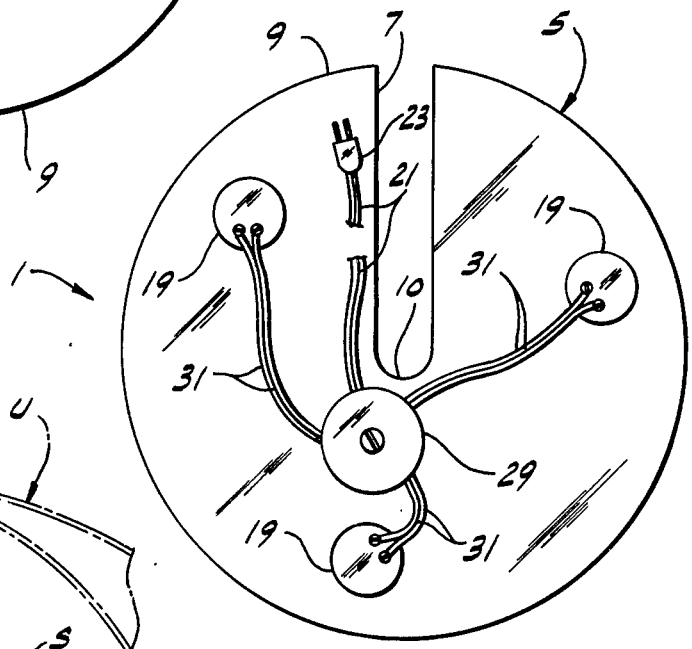
FIG. 4 is an enlarged top plan of a portable light fixture of the invention.

Mounted on the underside 11 of base 5 is at least one and preferably a plurality of electric light sources 13. These light sources, which are incandescent light bulbs, are preferably mounted in a symmetrical arrangement. Thus, for example, for the three light bulbs 13 shown in FIG. 3, holes 15 are drilled 120° or so apart in base 5 and a light socket 17 for one of the bulbs is fitted into each hole and secured to base 5 by a cap 19. Power for the light bulbs is supplied through a cord 21 having a connector 23 at one end which mates with, for example, a connector 25 of an extension cord 27. The other end of cord 21 is terminated at a junction or distribution box 29 mounted on the top surface 30 of base 5 and two-conductor cable sections 31 run from the distribution box to each light socket 17. When power is supplied to the light bulbs, their radiated light illuminates the area beneath umbrella U and in particular top 33 of table T.

To install light fixture 1 beneath umbrella U, one first inserts base 5, which has a maximum outside dimension less than the length of the strut S, between two adjacent umbrella struts S, aligns slot 7 with pole P and then slides the base forward until end 10 of the slot contacts the pole. This centers the fixture about the pole and base 5 is lowered until it rests on struts S in a horizontal position. Next, light bulbs 13 of a desired wattage are screwed into sockets 17. Extension cord 27 is then run to the umbrella from a convenient electrical outlet and taped or clamped to a rib R of the umbrella frame or, if preferred, the cord can be routed vertically down the umbrella pole and through the enlarged central hole in the table top, or through the pole itself. Connector 25 of the extension cord is mated with connector 23 of power cord 21 to complete the installation.

Since light from fixture 1 is only needed when it gets dark, a light switch may be included in distribution box 29 so that light bulbs 13 may be selectively energized and not left to burn continuously. The switch is provided with a pull chain 37 which is inserted through a hole 39 in base 5 to hang down from the base for easy access. Alternately an in-line switch in the electrical cord or cable may be used to turn the lights on and off. To increase the intensity of illumination provided to the area beneath umbrella U, the radial location of light bulbs 13 is preferably selected such that the majority of light radiated upwardly from the bulbs strikes underside 11 of base 5 and is reflected downward toward table T. If desired, another source of light may be installed on the upper surface of base 5 to illuminate the undersurface of the central portion of the umbrella.

When installed, fixture 1 is high enough above the top of table T that it does not interfere with persons using the table. Further, the fixture when mounted as illustrated in FIGS. 1 and 2 is protected by the umbrella and the struts from damage. Also, underside 11 of base 5 is preferably covered with a material similar in design and coloration to that of the umbrella to make light fixture 1 unobtrusive but attractive in appearance particularly during daylight hours when it is not in use.

To remove light fixture 1 from beneath umbrella U when, for example, table T is to be moved or the umbrella folded, power cord 21 is disconnected from extension cord 27, light bulbs 13 are unscrewed from their sockets 17 and base 5 is slid out from between the struts.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A portable lighting fixture for use with a patio umbrella and the like in which the umbrella is supported by a center pole having struts extending outwardly therefrom to the underside of the umbrella when the umbrella is in a raised position comprising:

a generally planar base of rigid material having a slot therein extending inwardly from an edge of the base toward and slightly beyond the center thereof, said slot having a relatively constant width approximately equal to but greater than that of the center pole for receiving the pole to removably install the base below the underside of the umbrella about the pole, the latter being at the inward end of the slot and said base being supported by the struts in a generally horizontal plane;

said base having a maximum outside dimension less than the length of one of the umbrella struts for enabling the base to be installed on and removed from the umbrella by passing it between two adjacent struts when the umbrella is in its raised position;

a plurality of electric light sources mounted on the underside of the base; and power means adapted for connection to a source of electrical energy for supplying power to the light source thereby to illuminate the area beneath the umbrella, said power means including manually-operable switch means for selectively controlling the flow of electricity to the light sources thereby allowing the latter to be selectively energized and deenergized.

2. A portable lighting fixture as set forth in claim 1 wherein the base is generally circular in shape and the slot is a radial slot.

3. A portable lighting fixture as set forth in claim 1 further including a plurality of electric light sources mounted on the underside of the base in a symmetrical arrangement the locations of which are such that light radiated upwardly from the light sources reflects off the underside of the base to increase the intensity of illumination of the area beneath the umbrella.

4. A portable lighting fixture as set forth in claim 3 wherein each light source is a light bulb and the power supply means further comprises a plurality of sockets on the underside of the base for holding said light sources, cap means mounted on the top of the base for securing the sockets to the base, junction box means atop the base adapted to be connected to the source of electrical energy, and means for conducting electricity from the junction box means to said sockets and thence to the light sources for illuminating the latter.

5. A portable lighting fixture as set forth in claim 1 wherein the underside of the base is covered with a material similar in design and coloration to that of the umbrella.

* * * * *